US009117433B2

(12) United States Patent
Yui et al.

(10) Patent No.: US 9,117,433 B2
(45) Date of Patent: Aug. 25, 2015

(54) TUNING DEVICE

(71) Applicant: ROLAND CORPORATION, Shizuoka (JP)

(72) Inventors: Hirofumi Yui, Shizuoka (JP); Shohei Okumura, Shizuoka (JP)

(73) Assignee: ROLAND CORPORATION, Shizuoka (JP)

( * ) Notice: Subject to any disclaimer, the term of this patent is extended or adjusted under 35 U.S.C. 154(b) by 0 days.

(21) Appl. No.: 13/961,901

(22) Filed: Aug. 8, 2013

(65) Prior Publication Data

US 2014/0041510 A1 Feb. 13, 2014

(30) Foreign Application Priority Data

Aug. 9, 2012 (JP) ..... 2012-177502

(51) Int. Cl.
*G10H 1/44* (2006.01)
*G10G 7/02* (2006.01)

(52) U.S. Cl.
CPC ... *G10H 1/44* (2013.01); *G10G 7/02* (2013.01)

(58) Field of Classification Search
USPC ..... 84/454
IPC ..... G10H 1/44
See application file for complete search history.

(56) References Cited

U.S. PATENT DOCUMENTS 4,281,577 A * 8/1981 Middleton ..... 84/454
4,327,623 A * 5/1982 Mochida et al. ..... 84/454
5,427,011 A * 6/1995 Steinberger ..... 84/454
7,271,329 B2 * 9/2007 Franzblau ..... 84/609
7,514,620 B2 * 4/2009 Friedman et al. ..... 84/454
7,560,634 B2 * 7/2009 Miyazawa ..... 84/454
7,777,116 B2 * 8/2010 Luciani ..... 84/456
2007/0169612 A1 * 7/2007 Miyazawa ..... 84/423 R
2008/0047414 A1 * 2/2008 Friedman et al. ..... 84/609
2008/0264238 A1 * 10/2008 Lemons ..... 84/454
2009/0129605 A1 * 5/2009 Camp et al. ..... 381/77
2009/0229446 A1 * 9/2009 Luciani ..... 84/456
2014/0041510 A1 * 2/2014 Yui et al. ..... 84/454

FOREIGN PATENT DOCUMENTS

JP 62-123699 8/1987
JP 2681432 11/1997
JP 4637341 2/2011
WO 2011018095 2/2011

* cited by examiner

*Primary Examiner* — David Warren
(74) *Attorney, Agent, or Firm* — Jianq Chyun IP Office

(57) ABSTRACT

A tuning device is provided. The sound to be tuned is inputted by an input means while a reference sound is produced by an output means. At least two pitches are detected independently from a mixture of the sound to be tuned and the reference sound by a pitch detection means. Based on pitch information of the reference sound acquired by an acquiring means, the pitch of the sound to be tuned is extracted by a pitch extraction means from the at least two pitches detected by the pitch detection means. Information about the pitch of the sound to be tuned is displayed by a display means under control of a display control means. Therefore, the user can easily perform tuning on the sound to be tuned, based on the pitch information displayed by the display means, while listening to the reference sound and producing the sound to be tuned.

12 Claims, 7 Drawing Sheets

| reference pitch name | range of the difference Δ of the pitch of the input sound relative to the reference pitch | luminance L (%) of each indicator of the pitch name display | | | | | | |
|---|---|---|---|---|---|---|---|---|
| | | … | B | C | C # | D | D # | … |
| ⋮ | ⋮ | … | ⋮ | ⋮ | ⋮ | ⋮ | ⋮ | … |
| C | −50cent≦Δ<−10cent | … | 80≧L>0 | 80≦L<100 | 0 | 0 | 0 | … |
| | −10cent≦Δ≦+10cent | | 0 | 100 | 0 | 0 | 0 | |
| | +10cent<Δ<+50cent | | 0 | 100>L>80 | 0<L<80 | 0 | 0 | |
| C # | −50cent≦Δ<−10cent | … | 0 | 80≧L>0 | 80≦L<100 | 0 | 0 | … |
| | −10cent≦Δ≦+10cent | | 0 | 0 | 100 | 0 | 0 | |
| | +10cent<Δ<+50cent | | 0 | 0 | 100>L>80 | 0<L<80 | 0 | |
| D | −50cent≦Δ<−10cent | … | 0 | 0 | 80≧L>0 | 80≦L<100 | 0 | … |
| | −10cent≦Δ≦+10cent | | 0 | 0 | 0 | 100 | 0 | |
| | +10cent<Δ<+50cent | | 0 | 0 | 0 | 100>L>80 | 0<L<80 | |
| ⋮ | ⋮ | … | ⋮ | ⋮ | ⋮ | ⋮ | ⋮ | … |

FIG. 2

| range of the difference Δ of the pitch of the input sound relative to the reference pitch | first indicator (indicator of " # ") | second indicator (indicator of " ♭ ") |
|---|---|---|
| +40cent < Δ ≦ +50cent | light-off | light-off |
| +5cent < Δ ≦ +40cent | light-on | light-off |
| −5cent ≦ Δ ≦ +5cent | light-on | light-on |
| −40cent ≦ Δ < −5cent | light-off | light-on |
| −50cent ≦ Δ < −40cent | light-off | light-off |

FIG. 4

TUNING DEVICE

CROSS-REFERENCE TO RELATED APPLICATIONS

This application claims the priority benefit of Japan application serial no. 2012-177502, filed on Aug. 9, 2012. The entirety of the above-mentioned patent application is hereby incorporated by reference herein and made a part of this specification.

BACKGROUND OF THE INVENTION

1. Field of the Invention

The invention relates to a tuning device and particularly relates to a tuning device that produces a sound (i.e. reference sound) of a pitch (i.e. reference pitch, which serves as the reference) of a reference pitch name as the tuning target and allows the user to check the pitch of a sound that is to be tuned from a mixture sound of the reference sound and the sound that is to be tuned.

2. Description of Related Art

A traditional tuning device cannot be used to carry out tuning for matching the pitch of the sound that is to be tuned, e.g. a vocal sound or a sound of a wind instrument such as a flute, while the reference sound is produced through a loudspeaker. The reason is that, when the loudspeaker outputs the reference sound, the tuning device may misidentify the reference sound it produces as the sound that is to be tuned and detect the wrong pitch, and as a result, fail to detect the pitch of the sound that is to be tuned. For this reason, the user first confines the reference sound produced via the loudspeaker by ear, and then stops the reference sound and inputs the sound that is to be tuned to the tuning device, so as to perform the tuning. However, for such a method, the user needs to listen to and remember the reference pitch so as to perform the tuning, which is rather difficult.

Regarding this, Patent Literature 1 discloses an electronic tuner that uses a mixture circuit to mix an audio signal of the sound that is to be tuned, which is inputted via an input terminal, with a reference sound signal (equivalent to the reference sound signal of Patent Literature 1), and outputs the mixture through headphones via an output terminal when the sound that is to be tuned, which is inputted via the input terminal, is inputted to a tuning circuit. With the electronic tuner of Patent Literature 1, the user can produce the sound that is to be tuned and perform the tuning while the user listens to the reference sound (equivalent to the reference sound of Patent Literature 1) through headphones to check the pitch of the reference sound.

In addition, Patent Literature 2 discloses a polyphonic tuner that has a pitch detector for simultaneously detecting several pitches.

PRIOR ART LITERATURE

Patent Literature

[Patent Literature 1]

Japanese Utility Model Application Publication No. 62-123699

[Patent Literature 2]

Publication No. WO 2011/018095

SUMMARY OF THE INVENTION

Problem to be Solved

In the case of using the tuning device of Patent Literature 1, however, headphones are necessary for the user to perform tuning on the sound that is to be tuned while the user listens to the reference sound. Without the headphones, the traditional tuning method, which requires the user to listen to the reference sound from the loudspeaker to check the pitch of the reference sound and then stop the reference sound and input the sound that is to be tuned for tuning, cannot be carried out.

The pitch detector of the traditional tuning device is suitable for simultaneously detecting several pitches, as disclosed in Patent Literature 2. However, it is not easy for the user to identify the pitch of the reference sound and the pitch of the sound that is to be tuned and to know how to tune the sound that is to be tuned.

In view of the aforementioned issues, the invention provides a tuning device that allows the user to easily perform tuning on the sound that is to be tuned.

Solution to the Problem and Effect of the Invention

Considering the above, in a tuning device of the invention, a reference sound of a designated pitch, among reference sounds that can be generated, is generated by a sound generation means and outputted by an output means. While the reference sound is outputted by the output means, if a sound that is to be tuned is mixed with the reference sound into a mixture sound and inputted by an input means, at least two pitches are independently detected by a pitch detection means from the mixture sound. Based on the pitch information of the reference sound that is acquired by an acquiring means, the pitch of the sound that is to be tuned is extracted by a pitch extraction means from the at least two pitches detected by the pitch detection means, and a first information related to the pitch of the sound that is to be tuned is displayed by a display means under control of a display control means. Therefore, in the case that the sound that is to be tuned is produced while the user listens to the reference sound generated by the sound generation means, the tuning device of the invention can detect the pitch of each sound respectively from the mixture sound of the reference sound and the sound that is to be tuned, and can display the first information related to the pitch of the sound that is to be tuned independently from the pitches of other sounds. This allows the user to easily perform tuning on the sound that is to be tuned based on the pitch information displayed by the display means while the user listens to the reference sound and produces the sound that is to be tuned.

In addition to the aforementioned effects, the tuning device of the invention further has the following effects. Information corresponding to a difference between the pitch of the sound that is to be tuned, which is extracted by the pitch extraction means, and the pitch of the reference sound, which is shown by the pitch information acquired by the acquiring means, is displayed by the display means as the first information related to the pitch of the sound that is to be tuned. Therefore, the user can check the deviation degree of the current pitch of the sound that is to be tuned relative to the pitch of the reference sound, based on the display performed by the display means, so as to perform tuning on the sound that is to be tuned visually and easily complete the tuning process.

BRIEF DESCRIPTION OF THE DRAWINGS

FIG. 2 is a table illustrating the relationship between the difference of the pitch of a sound that is to be tuned relative to the reference pitch and the luminance of each indicator of the pitch name display.

FIG. 4 is a table illustrating the difference of the pitch of the sound that is to be tuned relative to the reference pitch and lighting states of the first and second indicators.

DESCRIPTION OF THE EMBODIMENTS

Figure 1B:
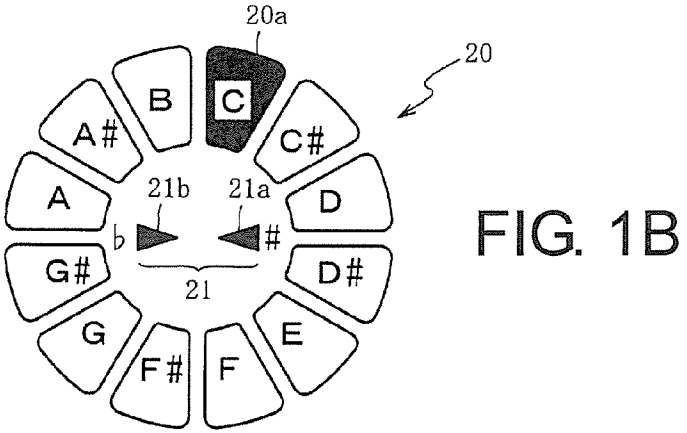
FIG. 1B to FIG. 1D are schematic diagrams illustrating the displays performed by a pitch name display and an auxiliary display.

Preferable exemplary embodiments of the invention are described in the following paragraphs with reference to the affixed figures. FIG. 1A is a schematic front view of a tuning device 1. The tuning device 1 is configured for tuning a vocal sound (voice) and an instrument sound, etc. and includes a pitch name display 20, an auxiliary display 21, a microphone 22, a loudspeaker 23, and an operation panel 15. The tuning device 1 detects the pitch of a sound that the user inputs via the microphone 22 and lights the pitch name display 20 and the auxiliary display 21 based on the detected pitch. Details thereof are provided hereinafter. Moreover, the tuning device 1 is capable of tuning the sound that is to be tuned while producing a reference sound via the loudspeaker 23.

The pitch name display 20 is configured to display a pitch name responsive to the pitch of the sound that is to be tuned or the pitch of the reference sound. The pitch name display 20 includes twelve indicators 20*a*-20*l* respectively corresponding to twelve pitch names (C, C#, D, D#, E, F, F#, G, G#, A, A#, B) that constitute an octave. In all the figures, the lowercase letter "1" is presented in cursive. The indicators 20*a*-20*l* are circumferentially arranged in a pitch order such that the pitch name (e.g. C) at one end and the pitch name (e.g. B) at the other end of the octave adjoin each other. Each of the indicators 20*a*-20*l* includes a translucent cover with a pitch name marked thereon and an LED (light emitting diode) covered by the cover. The indicators 20*a*-20*l* are lighted by the LEDs.

The auxiliary display 21 is configured to display a deviation of the pitch of the sound that is to be tuned relative to a reference pitch of a reference pitch name, which is determined according to the pitch of the sound that is to be tuned. The auxiliary display 21 is arranged on an inner side of the circumferentially arranged indicators 20*a*-20*l* and includes a first indicator 21*a* and a second indicator 21*b*. The first indicator 21*a* is configured to indicate a situation that the pitch of the sound that is to be tuned deviates to a sharp side (# side) relative to the reference pitch. The second indicator 21*b* is configured to indicate a situation that the pitch of the sound that is to be tuned deviates to a flat side (♭ side) relative to the reference pitch. Each of the first and second indicators 21*a* and 21*b* includes a translucent cover and an LED covered by the cover. The first and second indicators 21*a* and 21*b* are lighted by the LEDs.

Figure 1D:
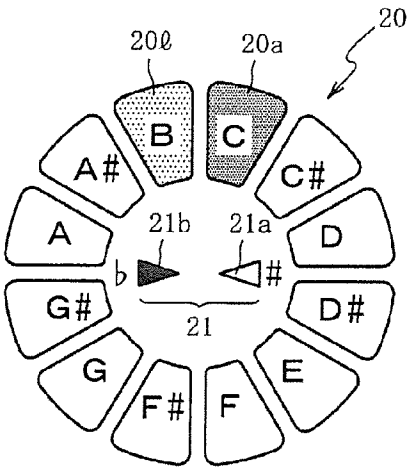
Figure 1C:
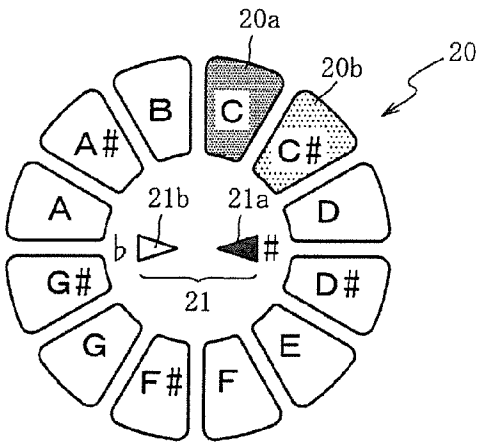
Figure 1A:
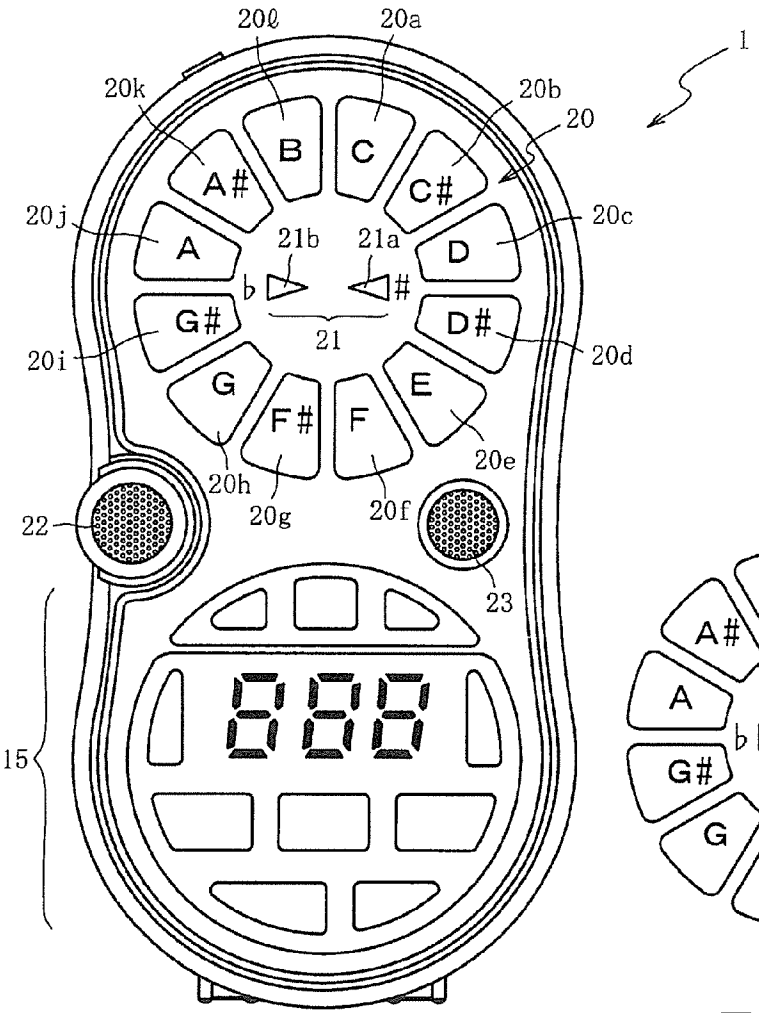
FIG. 1A is a schematic front view of a tuning device.

FIG. 1B to FIG. 1D are schematic diagrams illustrating the displays performed by the pitch name display 20 and the auxiliary display 21. FIG. 1B to FIG. 1D exemplify that the pitch name (i.e. the reference pitch name) determined responsive to the pitch of the sound that is to be tuned is "C."

According to the tuning device 1 of this exemplary embodiment, when the difference between the reference pitch (i.e. reference pitch "C") of the reference pitch name "C" and the pitch of the sound that is to be tuned is in an in-tune state, namely, the deviation of the pitch of the sound that is to be tuned relative to the reference pitch "C" is within a deviation tolerance range (i.e. the pitches roughly match musically), the indicator 20*a* which corresponds to the reference pitch name "C" is lighted at the maximum luminance (100%), and the adjacent indicators 20*b* and 201 are not lighted, as shown in FIG. 1B. By confirming that the indicator 20*a* is lighted at the maximum luminance and that the adjacent indicators 20*b* and 201 corresponding to pitch names C# and B are in a light-off state, the match of the pitch of the sound that is to be tuned and the reference pitch "C", namely successful tuning, can be visually determined. In the example of FIG. 1B to FIG. 1D, the lighted indicators of the indicators 20*a*-20*l* are hatched for illustrative purpose, and the difference in luminance is represented by different hatching (light or shade). To be more specific, darker hatching represents higher luminance while lighter hatching represents lower luminance. In FIG. 1B, the indicator 20*a* which is lighted at the maximum luminance is hatched the darkest.

When the difference between the reference pitch and the pitch of the sound that is to be tuned increases to a certain degree, one of the indicators 20*b* and 201 which are adjacent to the indicator 20*a* is lighted simultaneously with the indicator 20*a*, as illustrated in FIG. 1C and FIG. 1D. More specifically, in the case that the pitch of the sound that is to be tuned deviates to the sharp side relative to the reference pitch "C," the indicator 20*a* corresponding to the pitch name "C" and the indicator 20*b* corresponding to the pitch name "C#" are lighted. In the case that the pitch of the sound that is to be tuned deviates to the flat side relative to the reference pitch "C," the indicator 20*a* and the indicator 201 corresponding to the pitch name "B" are lighted. To explain in further detail, once the difference between the reference pitch "C" and the pitch of the sound that is to be tuned exceeds a predetermined threshold value, the luminance of the indicator 20*a* gradually decreases and the luminance of the adjacent indicator 20*b* or 20*l* gradually increases as an absolute value of the difference increases. Namely, when the pitch of the sound that is to be tuned deviates from the reference pitch "C" toward the reference pitch "C#" or "B" of the adjacent pitch name.

The auxiliary display 20 assists to indicate the deviation degree of the pitch of the sound that is to be tuned relative to the reference pitch. For instance, the tuning device 1 lights both of the first indicator 21*a* and the second indicator 21*b* when the difference of the pitch of the sound that is to be tuned relative to the reference pitch is smaller than a predetermined value. Here, the predetermined value is a tolerance range of pitch deviation relative to the reference pitch, within which the pitch of the sound that is to be tuned is determined as matching the reference pitch, and the first indicator 21*a* and the second indicator 21*b* are lighted simultaneously to notify the user that the pitch of the sound that is to be tuned matches the reference pitch, namely, when the tuning is completed (the in-tune state).

Furthermore, when two adjacent indicators of the pitch name display 20 are lighted at the same time, namely, the difference of the pitch of the sound that is to be tuned relative to the reference pitch increases to a certain degree (i.e. not in the in-tune state), only one of the first indicator 21*a* and the second indicator 21*b* is lighted based on whether the pitch of the sound that is to be tuned deviates toward the sharp side or the flat side of the reference pitch. As shown in FIG. 1C, for example, if the pitch of the sound that is to be tuned deviates toward the sharp side relative to the reference pitch, the first indicator 21*a* (indicator of "#") is lighted. On the other hand, as shown in FIG. 1D, if the pitch of the sound that is to be tuned deviates toward the flat side relative to the reference pitch, the second indicator 21*b* (indicator of "♭") is lighted. Since one of the first indicator 21*a* and the second indicator 21*b* is lighted responsive to a deviation direction of the pitch of the sound that is to be tuned relative to the reference pitch, this auxiliary information, in addition to the information provided by the pitch name display 20 about the deviation direction of the pitch of the sound that is to be tuned, makes it easy for the user to learn the deviation direction.

Figure 3:
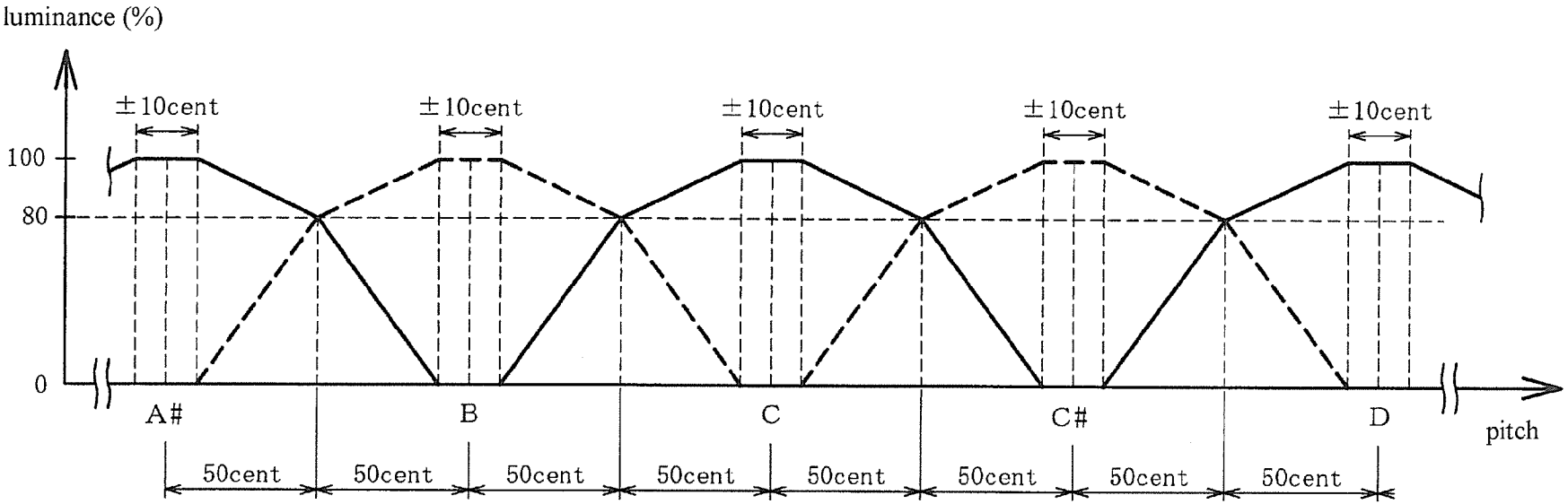
FIG. 3 is a graph illustrating the luminance variation of each indicator with respect to the pitch of the sound that is to be tuned.

FIG. 2 is a table illustrating the relationship between the difference of the pitch of the sound that is to be tuned relative to the reference pitch and the luminance of each indicator 20*a*-20*l* of the pitch name display 20. FIG. 3 is a graph illustrating the luminance variation of each indicator 20*a*-20*l* with respect to the pitch of the sound that is to be tuned. With reference to the graph of FIG. 3, the horizontal axis represents the pitch and the vertical axis represents the luminance (%). As mentioned above, among the indicators 20*a*-20*l*, only one indicator that corresponds to the reference pitch is lighted, or two indicators (i.e. the indicator corresponding to the reference pitch and one indicator adjacent thereto) are lighted simultaneously according to the difference (i.e. a value obtained by subtracting the reference pitch from the pitch of the sound that is to be tuned) of the pitch of the sound that is to be tuned relative to the reference pitch.

FIG. 4 is a table illustrating the difference of the pitch of the sound that is to be tuned relative to the reference pitch and lighting states of the first and second indicators 21*a* and 21*b* of the auxiliary display 21. As shown in FIG. 4, the first indicator 21*a* and the second indicator 21*b* are lighted or not lighted responsive to the difference Δ between the pitch of the sound that is to be tuned and the reference pitch. More specifically, in the case that the difference Δ is in the range of −5 cent≤Δ≤+5 cent, the first indicator 21*a* and the second indicator 21*b* are both lighted (light-on) to notify the user that the pitch of the sound that is to be tuned matches the reference pitch, namely the in-tune state. Here, the range of the difference Δ where both of the first indicator 21*a* and the second indicator 21*b* are lighted is set to be narrower than a range of the difference Δ (−10 cent≤Δ≤+10 cent) where only the indicator corresponding to the reference pitch name is lighted. With this setting, by confirming one of the indicators 20*a*-20*l* is solely lighted at the luminance of 100%, the user first learns that the pitch of the sound that is to be tuned is in an in-tune state and is near the reference pitch within a wide range (referred to as a "first in-tune state" hereinafter). Then, by lighting the first indicator 21*a* and the second indicator 21*b* simultaneously, the user learns that the pitch of the sound that is to be tuned approximates to the reference pitch within a narrow range and enters another in-tune state (referred to as a "second in-tune state" hereinafter).

Moreover, in the case that the difference Δ is in the range of +5 cent<Δ≤+40 cent, namely, when the pitch of the sound that is to be tuned gets higher and exceeds +5 cent relative to the reference pitch, only the first indicator 21*a* (i.e. indicator of "#") is lighted. In the case that the difference Δ is in the range of −40 cent≤Δ<−5 cent, namely, when the pitch of the sound that is to be tuned gets lower and drops under −5 cent relative to the reference pitch, only the second indicator 21*b* (i.e. indicator of "♭") is lighted. Accordingly, the user can know whether the pitch of the sound that is to be tuned is higher or lower than the reference pitch based on the lighting of the first indicator 21*a* and the second indicator 21*b*. The deviation tolerance ranges of the first and second in-tune states relative to the reference pitch may be selected or adjusted by the user according to the performer's proficiency level or purpose of practice.

Moreover, in the case that the difference Δ is in the range of +40 cent<Δ≤+50 cent or −50 cent≤Δ<−40 cent, the first indicator 21*a* and the second indicator 21*b* are not lighted (light-off). Accordingly, near the middle between the pitches corresponding to adjacent pitch names, namely, near a pitch at which the reference pitch name is switched, none of the first indicator 21*a* and the second indicator 21*b* is lighted, so as to prevent disordered display that may occur when switching the reference pitch name.

Figure 5A:
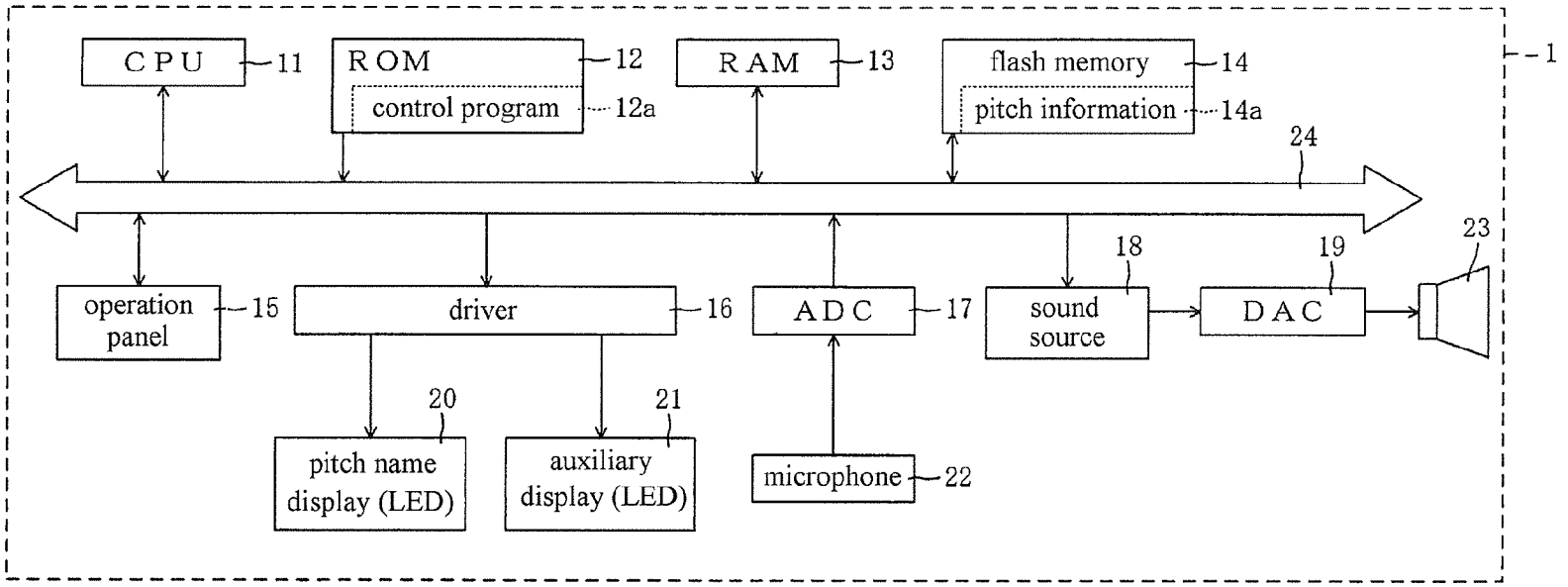
FIG. 5A is a block diagram illustrating an electrical structure of the tuning device.

FIG. 5A is a block diagram illustrating an electrical structure of the tuning device 1. The tuning device 1 includes a CPU 11, a ROM 12, a RAM 13, a flash memory 14, the operation panel 15, a driver 16, an analog-to-digital converter (ADC) 17, a sound source 18, a digital-to-analog converter (DAC) 19, the pitch name display 20, the auxiliary display 21, the microphone 22, and the loudspeaker 23. The components 11-18 are connected with each other via a bus line 24. The microphone 22 is connected to the ADC 17. The DAC 19 is connected to the sound source 18 and the loudspeaker 23. The pitch name display 20 and the auxiliary display 21 are connected to the driver 16.

Figure 6:
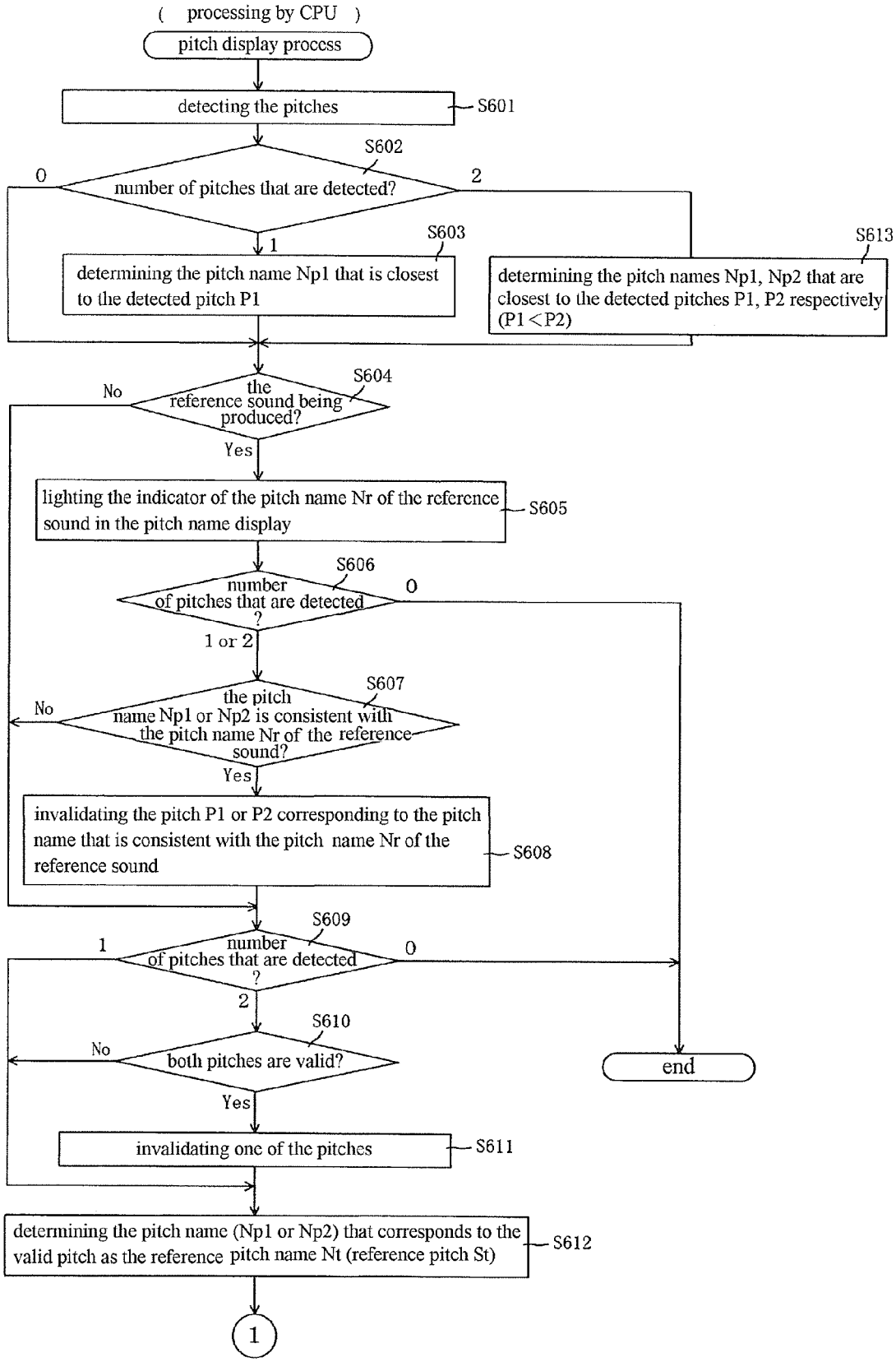
FIG. 6 is a flowchart illustrating the pitch display process.
Figure 7:
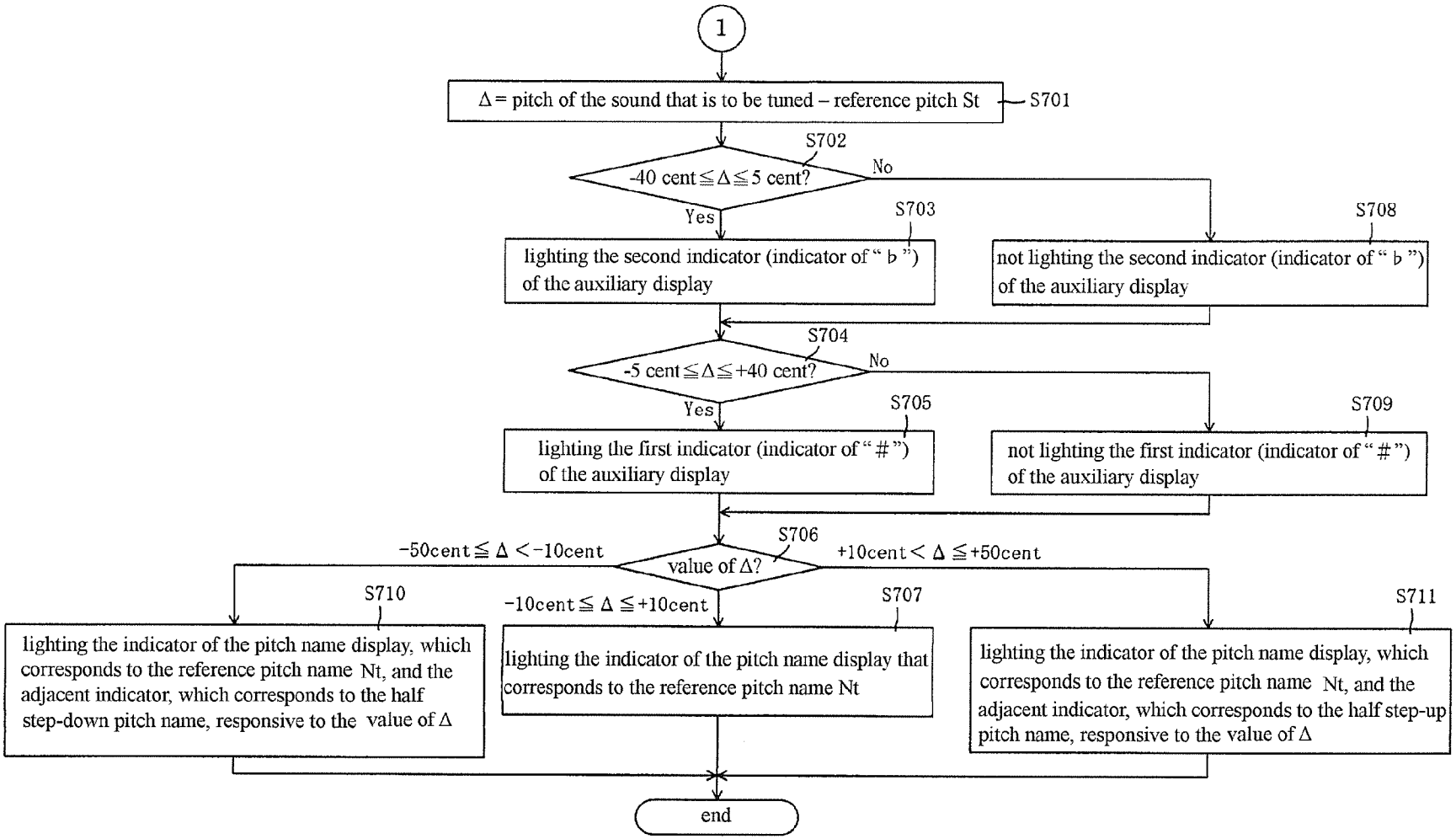
FIG. 7 is a flowchart illustrating the pitch display process.

The CPU 11 is a central control device that controls each component of the tuning device 1 according to fixed values and programs stored in the ROM 12 and data stored in the RAM 13. The CPU 11 includes a timer (not shown in the figure) therein for measuring time by counting a clock signal. The ROM 12 is an unrewritable non-volatile memory that stores a control program 12*a* executed by the CPU 11 and fixed value data (not shown in the figure) referred by the CPU 11 when the control program 12*a* is executed, etc. In addition, the processes in the flowcharts of FIG. 6 and FIG. 7 are executed on the basis of the control program 12*a*.

The RAM 13 is a rewritable volatile memory that has a temporary area for temporarily storing various data upon the execution of the control program 12*a* performed by the CPU 11. The flash memory 14 is a rewritable non-volatile memory which stores pitch information 14*a* with respect to the reference sound of each pitch for the user's reference during the tuning.

The operation panel 15 is a panel provided with an operator for the user to input various instructions and indicators composed of 7-segment LEDs, etc. The operation panel 15 includes a reference pitch name designation operator 39 (see FIG. 5B) for designating the reference pitch name. When the reference pitch name designation operator 39 designates the pitch name of the reference sound, the sound source 18 produces the reference sound of the designated pitch name based on the pitch information 14*a* of the designated pitch name.

The driver 16 is an LED driver that is connected to the LEDs respectively provided to the indicators 20*a*-20*l* of the pitch name display 20 and the LEDs respectively provided to the indicators 21*a* and 21*b* of the auxiliary display 21 for lighting the LEDs. The driver 16 lights the LED of the indicated target in accordance with the control information, which indicates the lighting form, inputted from the CPU 11. The driver 16 controls the luminance of each LED by pulse width modulation (PWM) control. Therefore, if the control information provided from the CPU 11 is information that designates the luminance of the LED, a power pulse with a duty ratio corresponding to the designated luminance is supplied to the control target, i.e. the LED. Accordingly, the LEDs respectively provided to the indicators 20*a*-20*l* and the indicators 21*a* and 21*b* are lighted at the luminance corresponding to the duty ratio of the supplied power pulse, namely, the luminance designated by the CPU 11. In this exemplary embodiment, the LEDs of the indicators 20*a*-20*l* are multi-color LEDs (three-color LEDs in this exemplary embodiment) that emit lights of colors responsive to the control information of the CPU 11.

Figure 5B:
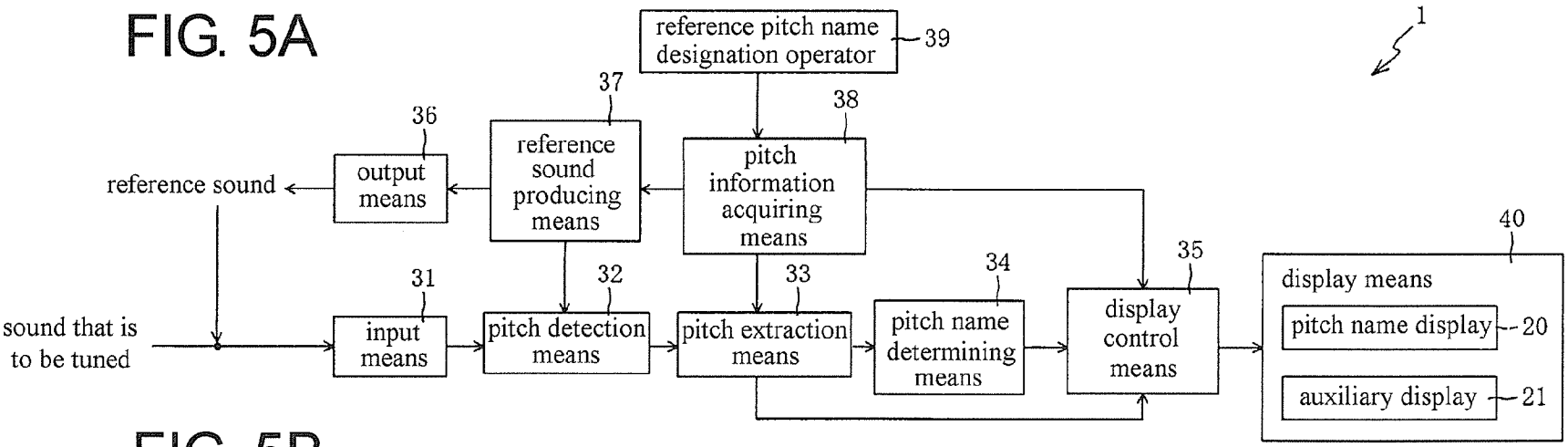
FIG. 5B is a functional block diagram illustrating functions of the tuning device.

FIG. 5B is a functional block diagram illustrating functions of the tuning device 1. As illustrated in FIG. 5B, the tuning device 1 includes an input means 31, a pitch detection means 32, a pitch extraction means 33, a pitch name determining means 34, a display control means 35, an output means 36, a reference sound producing means 37, a pitch information acquiring means 38, the reference pitch name designation operator 39, and a display means 40.

The reference pitch name designation operator 39 is one of the operators installed on the operation panel 15 and is operated by the user for the user to designate the pitch name of the reference sound. When the user operates the reference pitch name designation operator 39 to designate the reference pitch name, information indicating the designated pitch name is provided to the pitch information acquiring means 38.

The pitch information acquiring means 38 has a function of acquiring reference pitch information corresponding to the reference sound designated through the reference pitch name designation operator 39, which is achieved through the CPU 11, etc. The pitch information acquiring means 38 reads out the pitch information 14*a*, which corresponds to the reference pitch name information provided via the reference pitch name designation operator 39, from the flash memory 14 and provides the pitch information 14*a* to the reference sound producing means 37, the pitch extraction means 33, and the display control means 35.

The reference sound producing means 37 is constituted by the sound source 18, etc., and configured for producing the reference sound responsive to the pitch information 14*a* provided from the pitch information acquiring means 38 and providing the reference sound to the output means 36. The output means 36 is configured for outputting an output sound, which is achieved through the DAC 19 and the loudspeaker 23, etc. The output means 36 outputs the reference sound generated by the reference sound producing means 37 as the output sound.

The input means 31 has a function of inputting an input sound from the outside into the tuning device 1, and is implemented by the microphone 22 and the ADC 17, etc. The input means 31 provides the input sound to the pitch detection means 32. Therefore, if the user produces the sound that is to be tuned, such as a vocal sound or an instrument sound, etc. while outputting the reference sound via the output means 36, a mixture sound of the sound that is to be tuned and the reference sound is inputted into the input means 31 as the input sound, and in such a case, the mixture sound is provided to the pitch detection means 32.

The pitch detection means 32 has a function of detecting the pitch of the input sound provided from the input means 31 and is implemented by the CPU 11, etc. The pitch detection means 32 of this exemplary embodiment is capable of detecting the pitches of two sounds independently. Therefore, when the mixture sound of the sound that is to be tuned and the reference sound is inputted to the input means 31, the pitch detection means 32 detects the pitch of the sound that is to be tuned and the pitch of the reference sound respectively. Since the method for detecting multiple pitches (pitches of two sounds, for example) is commonly known, details will not be described hereinafter. Moreover, the pitch detection means 32 acquires information about whether the reference sound is mixed with the input sound inputted from the reference sound producing means 37 to the input means 31, and the pitch information 14*a* and waveform data information, etc., of the reference sound. Hence, even if the reference pitch of the sound that is to be tuned is consistent with the pitch of the reference sound, the pitch of the sound that is to be tuned can still be detected through the traditional methods, such as FFT analysis, etc. The pitch detection means 32 provides the detected pitch to the pitch extraction means 33.

The pitch extraction means 33 is configured for extracting the pitch of the sound that is to be tuned from the pitch detected by the pitch detection means 32, and is implemented by the CPU 11, etc. More specifically, among the pitches of the two sounds detected by the pitch detection means 32, the one that matches the pitch information 14*a* provided from the pitch information acquiring means 38 is identified (as the reference pitch), and the other one, which is not the reference pitch, is extracted as the pitch of the sound that is to be tuned. The pitch extraction means 33 provides the extracted pitch of the sound that is to be tuned to the pitch name determining means 34 and the display control means 35.

The pitch name determining means 34 has a function of determining the pitch name of the sound that is to be tuned, which is achieved through the CPU 11, etc. The pitch name determining means 34 determines the reference pitch name and the reference pitch of the sound that is to be tuned based on the pitch of the sound that is to be tuned, which is provided from the pitch extraction means 33. More specifically, the pitch name determining means 34 selects the pitch name that is closest to the pitch of the input sound as the reference pitch name and determines the reference pitch corresponding to the reference pitch name. The pitch name determining means 34 provides the determined reference pitch name and reference pitch to the display control means 35.

The display control means 35 has a function of controlling the lighting of the pitch name display 20 and the lighting of the auxiliary display 21, and is implemented by the CPU 11 and the driver 16, etc. The display control means 35 supplies the power pulse with the duty ratio corresponding to the lighting luminance to indicators, which are lighting targets among the indicators 20*a*-20*l* of the pitch name display 20 and the indicators 21*a* and 21*b* of the auxiliary display 21, according to the pitch of the sound that is to be tuned provided from the pitch extraction means 33 and the reference pitch name and reference pitch provided from the pitch name determining means 34.

The display control means 35 supplies the power pulse with the duty ratio corresponding to the lighting luminance to the indicator among the indicators 20*a*-20*l* of the pitch name display 20, which corresponds to the pitch name of the reference sound designated by the reference pitch name designation operator 39, according to the pitch information 14*a* that corresponds to the reference sound provided from the pitch information acquiring means 38. In this exemplary embodiment, the display control means 35 is configured to light the indicator, which corresponds to the sound that is to be tuned, and the indicator, which corresponds to the reference sound, in different lighting forms. To be more specific, the display control means 35 performs control to make the light color of the indicator corresponding to the sound that is to be tuned and the light color of the indicator corresponding to the reference sound different from each other. According to this exemplary embodiment, the display control means 35 controls the light color of the indicator corresponding to the sound that is to be tuned to be red and controls the light color of the indicator corresponding to the reference sound to be white.

The display means 40 has a lighting function and is implemented by the LEDs respectively provided to the indicators 20*a*-20*l* of the pitch name display 20 and the LEDs respectively provided to the indicators 21*a* and 21*b* of the auxiliary display 21. When the display control means 35 supplies the power pulse, the LED (display means 40), which is determined as the lighting target by the display control means 35, lights with a specific light color and luminance.

FIG. 6 and FIG. 7 are flowcharts illustrating the pitch display process performed by the CPU 11 of the tuning device 1 having the aforementioned structure. The pitch display process is a process for controlling the display performed by the pitch name display 20 and the auxiliary display 21 on the basis of the detected pitch of the input sound inputted from the microphone 22. The pitch display process is initiated upon the instruction of start of the tuning process and is executed repeatedly at predetermined time intervals thereafter by predetermined operations to the operation panel 15.

First, the CPU 11 detects the pitch P of the input sound (S601). If only one pitch (P1) is detected (S602: 1), the CPU 11 determines the pitch name Np1, which is closest to the detected pitch P1 (S603), and moves on to S604. If the number of the pitches that are detected is 2 (S602: 2), the CPU 11 determines pitch names Np1 and Np2, which are closest to the detected two pitches P1 and P2 respectively (P1<P2) and moves on to S604. Moreover, if no pitch is detected (S602: 0), the CPU 11 moves on to S604.

Referring to S604, if the loudspeaker 23 does not produce the reference sound of the pitch name designated through the user's operation of the reference pitch name designation means 39 (S604: No), the CPU 11 moves on to S609. However, if the loudspeaker 23 produces the reference sound (S604: Yes), the CPU 11 outputs control information to the driver 16 to make the indicator of the pitch name display 20, which corresponds to the pitch name Nr of the reference sound, emit white light at the luminance of 100% (S605) and moves on to S606.

Referring to S606, if no pitch is detected in S601 (S606: 0), the process is terminated. If the number of the detected pitches is 1 or 2 (S606: 1 or 2) and one of the pitch names Np1 and Np2 is consistent with the pitch name Nr (S607: Yes), the CPU 11 invalidates the pitch P1 or P2 corresponding to the pitch name, which is consistent with the pitch name Nr (S608), and moves on to S609. Through the processing of S608, the pitch of the sound that is to be tuned, which is not the reference sound, is extracted from the input sound inputted via the microphone 22 as a valid pitch. In S607, if none of the pitch names Np1 and Np2 is consistent with the pitch name Nr (S607: No), the CPU 11 moves on to S609.

Referring to S609, if no pitch is detected in S601 (S609: 0), the process is terminated. If the number of the pitches detected is 1 (S609: 1), the CPU 11 moves on to S612. Moreover, if the number of the pitches detected is 2 (S609: 2) and the number of valid pitches is 0 or 1 (S610: No), the CPU 11 also moves on to S612.

Besides, in S610, if the two pitches are both valid (S610: Yes), the CPU 11 invalidates one of the pitches P1 and P2 (S611) and moves on to S612. Through the processing of S611, one of the two pitches detected from the input sound is extracted as the pitch of the sound that is to be tuned. In this exemplary embodiment, the pitch P2, which is the higher pitch, is invalidated; however, the lower pitch P1 or the pitch that is smaller in the sound level may be invalidated instead.

Next, the pitch name (Np1 or Np2) that is determined according to the valid pitch is determined as the reference pitch name Nt (reference pitch St) (S612). Through the processing of S612, the pitch name, which is determined according to the pitch of the sound that is extracted as the sound that is to be tuned, is made the reference pitch name Nt.

Thereafter, the CPU 11 subtracts the reference pitch St determined in S612 from the pitch of the sound that is to be tuned (namely, valid pitch P1 or P2), and calculates the difference Δ of the pitch of the sound that is to be tuned relative to the reference pitch St in a unit of cent (S701).

If the CPU 11 judges that the difference Δ obtained in S701 is in the range of −40 cent or more and +5 cent or less (S702: Yes), the CPU 11 outputs control information to the driver 16 so as to light the LED of the second indicator 21*b* (i.e. indicator of "♭") of the auxiliary display 21 at the luminance of 100% (S703). On the other hand, if the CPU 11 judges that the difference Δ is not in the range of −40 cent or more and +5 cent or less (S702: No), the CPU 11 outputs control information to the driver 16 to make the LED of the second indicator 21*b* light-off (S708). Accordingly, in the case that the difference Δ of the pitch of the sound that is to be tuned relative to the reference pitch St is within the range of −40 cent≤Δ≤+5 cent, the second indicator 21*b* is lighted. Outside this range, the second indicator 21*b* is not lighted.

Moreover, if the CPU 11 judges that the difference Δ obtained in S701 is in the range of −5 cent or more and +40 cent or less (S704: Yes), the CPU 11 outputs control information to the driver 16 so as to light the LED of the first indicator 21*a* (i.e. indicator of "#") of the auxiliary display 21 at the luminance of 100% (S705). On the other hand, if the CPU 11 judges that the difference Δ is not in the range of −5 cent or more and +40 cent or less (S704: No), the CPU 11 outputs control information to the driver 16 to make the LED of the first indicator 21*a* light-off (S709). Accordingly, in the case that the difference Δ of the pitch of the sound that is to be tuned relative to the reference pitch St is within the range of −5 cent≤Δ≤+40 cent, the first indicator 21*a* is lighted. Outside this range, the first indicator 21*a* is not lighted.

Further, if the CPU 11 judges that the difference Δ obtained in S701 is in the range of −10 cent≤Δ≤+10 cent (S706: −10 cent<Δ<+10 cent), the CPU 11 outputs control information to the driver 16 so as to make the indicator of the pitch name display 20, which corresponds to the reference pitch name Nt, emit red light at the luminance of 100% (S707), and terminates the process. Accordingly, in the case that the difference Δ of the pitch of the sound that is to be tuned relative to the reference pitch St is within the range of −10 cent<Δ<+10 cent, the indicator corresponding to the reference pitch name Nt is lighted at the luminance of 100%.

If the CPU 11 judges that the difference Δ obtained in S701 is in the range of −50 cent≤Δ<−10 cent (S706: −50 cent≤Δ<−10 cent), the CPU 11 outputs control information to the driver 16 so as to make the indicator of the pitch name display 20, which corresponds to the reference pitch name Nt, and the indicator, which is adjacent to the aforesaid indicator and corresponds to the half step-down pitch, emit red light at the luminance corresponding to the difference Δ (S710), and terminates the process. In S710, for example, the luminances of the two indicators are determined in accordance with the relationship illustrated by the graph of FIG. 3. Accordingly, in the case that the difference Δ of the pitch of the sound that is to be tuned relative to the reference pitch St is in the range of −50 cent≤Δ<−10 cent, the luminance of the indicator corresponding to the reference pitch name Nt gradually decreases as the absolute value of the difference Δ increases, and the luminance of the indicator that is adjacent to the aforesaid indicator and corresponds to the half step-down pitch increases as the absolute value of the difference Δ increases.

In addition, if the CPU 11 judges that the difference Δ obtained in S701 is in the range of +10 cent<Δ≤+50 cent (S706: +10 cent<Δ≤+50 cent), the CPU 11 outputs control information to the driver 16 so as to make the indicator of the pitch name display 20, which corresponds to the reference pitch name Nt, and the indicator, which is adjacent to the aforesaid indicator and corresponds to the half step-up pitch, emit red light at the luminance corresponding to the difference Δ (S711), and terminates the process. In S711, for example, the luminances of the two indicators are determined in accordance with the relationship illustrated by the graph of FIG. 3. Accordingly, in the case that the difference Δ of the pitch of the sound that is to be tuned relative to the reference pitch St is within the range of +10 cent<Δ≤+50 cent, the luminance of the indicator corresponding to the reference pitch name Nt gradually decreases as the absolute value of the difference Δ increases, and the luminance of the indicator that is adjacent to the aforesaid indicator and corresponds to the half step-up pitch increases as the absolute value of the difference Δ increases.

As described above, the tuning device 1 of this exemplary embodiment has the pitch detection means 32 for detecting the pitches of two sounds independently. Therefore, in the case that the sound that is to be tuned is inputted via the microphone 22 while the reference sound is produced from the loudspeaker 23, the pitch of the sound that is to be tuned and the pitch of the reference sound can be independently detected. Moreover, the pitch extraction means 33 extracts the pitch of the sound that is to be tuned from the pitches detected by the pitch detection means 32 for the pitch name display 20 to perform display corresponding to the pitch of the sound that is to be tuned. Thereby, the user does not require headphones, etc., and can adjust the pitch of a vocal sound or instrument sound, i.e. the sound that is to be tuned, to be closer to the pitch of the reference sound while listening to the reference sound from the loudspeaker 23, and can easily carry out tuning on the sound that is to be tuned by checking the reference sound through the pitch name display 20. Furthermore, with the tuning device 1 of this exemplary embodiment, the user can practice harmony by making the sound that is to be tuned, e.g. a vocal sound or instrument sound, into a harmonic sound, which has an interval of major third or perfect fifth with respect to the pitch of the reference sound, while the user listens to the reference sound from the loudspeaker 23.

Particularly, when the difference of the pitch of the sound that is to be tuned relative to the reference pitch, which is determined according to the pitch of the sound that is to be tuned, is small and within the range that can be determined as matching the reference pitch, only one of the twelve indicators 20*a*-20*l* of the pitch name display 20, which corresponds to the pitch name (the reference pitch name) determined according to the pitch of the sound that is to be tuned, is lighted at the maximum luminance (i.e. in-tune state), and the two indicators adjacent thereto are not lighted. On the other hand, when the difference of the pitch of the sound that is to be tuned relative to the reference pitch increases to a certain degree, the indicator, which corresponds to the reference pitch name, and the indicator, which corresponds to the pitch name adjacent to the reference pitch name and close to the pitch of the sound that is to be tuned, are both lighted. As the absolute value of the difference between the reference pitch and the pitch of the sound that is to be tuned increases (that is, as the pitch of the sound that is to be tuned deviates away from the reference pitch), the luminance of the indicator corresponding to the reference pitch name gradually decreases, and at the same time, the luminance of the adjacent indicator gradually increases. Accordingly, the user can know what reference pitch name the pitch of the sound that is to be tuned corresponds to, and can intuitively check the deviation degree of the pitch of the sound that is to be tuned, i.e. the tuning target sound, relative to the reference pitch by looking at the luminance degrees of two adjacent indicators of the pitch name display 20.

The tuning device 1 of this exemplary embodiment lights the indicator, among the indicators 20*a*-20*l* of the pitch name display 20, which corresponds to the pitch of the sound that is to be tuned for the user to easily check the current pitch of the sound that is to be tuned through the position of the lighted indicator. Moreover, since the indicator that corresponds to the pitch name of the reference sound designated by the user and the indicator that corresponds to the pitch of the sound that is to be tuned are lighted with different light colors on the same pitch name display 20, the user can easily distinguish the sound that is to be tuned from the pitch name of the reference sound. What is more, the user can clearly see the direction (the pitch is high or low) and the interval (the pitch difference) by which the pitch name of the current pitch of the sound that is to be tuned departs from the pitch name of the reference sound by taking a look at the position relationship between the indicators lighted corresponding to the reference sound and the sound that is to be tuned. Thus, with the tuning device 1, the user can easily practice how to match the pitch of the sound that is to be tuned, e.g. a vocal sound or instrument sound, to the pitch of the reference sound, or practice harmony to make the sound that is to be tuned a harmonic sound with accurate intervals relative to the reference sound.

The above illustrates the invention with reference to the exemplary embodiments. However, it should be understood that the invention is not limited to any of these exemplary embodiments, and various modifications or alterations may be made without departing from the spirit of the invention.

For instance, the values given in the aforementioned exemplary embodiments are merely examples, and other values may also be adopted for the invention.

In the aforementioned exemplary embodiments, three-color LEDs are used on the indicators 20*a*-20*l* of the pitch name display 20, and different light colors are used to distinguish the pitch name of the reference sound, and the pitch name and pitch deviation of the sound that is to be tuned. However, single-color LEDs may also be used on the indicators 20*a*-20*l*. In that case, the light corresponding to the pitch name of the reference sound may be turned on and off intermittently at the luminance of 60% for a specific period of about 250 ms repeatedly, for example, so that the pitch name of the reference sound, and the pitch name and pitch deviation of the sound that is to be tuned can be presented in different display forms.

In the aforementioned exemplary embodiments, the pitch name display 20, which has the indicators 20*a*-20*l* circumferentially arranged thereon, is configured to emit light responsive to the pitch of the sound that is to be tuned. However, two indicators of the conventional tuning device, i.e. a pitch name display for indicating one reference pitch name and an auxiliary display for indicating the deviation relative to the reference pitch name, may also be used to indicate the reference pitch name, which is determined according to the pitch of the sound that is to be tuned, and the deviation degree (difference) of the pitch of the sound that is to be tuned relative to the reference pitch corresponding to the reference pitch name. Moreover, the sound to be tuned, the reference pitch name of the reference pitch, the reference pitch, and the like and the deviation degree of the pitch relative to the reference pitch may also be presented by means of values, symbols, or character representations of pitch names.

In the aforementioned exemplary embodiments, the indicators 20*a*-20*l* of the pitch name display 20 are arranged circumferentially. Nevertheless, the arrangement of the indicators 20*a*-20*l* is not limited thereto, and the indicators 20*a*-20*l* may be arranged in various circular forms, which put two end pitch names (e.g. pitch names "C" and "B") of a pitch name sequence that includes twelve pitches of one octave adjacent to each other. For example, the twelve indicators 20*a*-20*l* may be arranged in an elliptical form or a polygonal form, such as, hexangular or dodecagonal arrangement, etc.

In the aforementioned exemplary embodiments, the indicators 20*a*-20*l* of the pitch name display 20 are lighted using LEDs as the light source. However, the pitch name display may also be displayed on an LCD and include twelve circumferentially-arranged indicators to respectively serve as the indicators 20*a*-20*l*, and the same as the aforementioned exemplary embodiments, the indicators may be respectively lighted at the luminance corresponding to the difference between the reference pitch and the pitch of the sound that is to be tuned. For such an arrangement, the display positions of the twelve indicators can be properly changed according to the scale and the reference pitch name.

In the aforementioned exemplary embodiments, the pitch information acquiring means 38 is configured to acquire the pitch of the reference sound that is designated through the reference pitch name designation operator 39, based on the pitch information 14*a* stored in the flash memory 14. In place of that, a pitch detection means may be installed to internally detect the pitch of the reference sound that is produced by the reference sound producing means 37, and the pitch information acquiring means 38 may be configured to acquire the pitch detected by the pitch detection means as the pitch of the reference sound. In such a configuration, the reference sound is not necessarily a long single tone and may be musical data of a scale etude or musical composition, etc. More specifically, musical data for scale practice, which is used for producing several reference sounds of different pitches in turn at a specific tempo, may be stored in the flash memory 14, etc., beforehand as an etude to be used as the model of scale practice, and during the scale practice of vocal sounds or instrument sounds, etc., the stored musical data may be produced (reproduced) via the sound source 18 to serve as a model performance. Since the tuning device 1 of the aforementioned exemplary embodiments is capable of detecting the pitch of the sound that is to be tuned from the mixture sound of the reference sound and the sound that is to be tuned, while music is reproduced via the loudspeaker 23 as a model performance, the user can practice singing or playing the instrument to make the sound that is to be tuned match the pitch of each reference sound of the reproduced music. In addition, the user can also practice harmony (two-toned chorus) for a song while listening to the vocal sound that serves as the reference sound.

In the aforementioned exemplary embodiments, among the indicators 20*a*-20*l* of the pitch name display 20, the indicator that corresponds to the pitch of the sound that is to be tuned and the indicator that corresponds to the pitch name of the reference sound are lighted with different colors. However, the tuning device 1 may also be configured to omit the lighting of the indicator that corresponds to the reference sound and only produce the reference sound. Besides, the indicator that corresponds to the pitch name of the reference sound and the indicator that corresponds to the pitch of the sound that is to be tuned may be disposed separately and independently. For instance, white LEDs may be respectively arranged in positions along an inner periphery or outer periphery of the indicators 20*a*-20*l* of the pitch name display 20 to serve as indicators exclusively for displaying the reference sound. By doing so, in the midst of tuning the sound that is to be tuned, the display of the reference sound is performed by the exclusive indicators, which is independent from the display of the sound that is to be tuned performed by the pitch name display 20. For example, when the reference pitches of the sound that is to be tuned and the reference sound are consistent with each other and the pitch of the sound that is to be tuned is in-tune or nearly in-tune and causes the corresponding indicator to be lighted at the luminance of 100%, the display of the reference sound is independently performed by the exclusive indicators for the user to check the pitch name of the reference sound and the tuning state of the sound that is to be tuned visually.

In the aforementioned exemplary embodiments, the tuning device 1 includes the microphone 22 (built-in microphone). However, the tuning device 1 may be provided with an input terminal to be connected with a microphone for inputting the sound that is to be tuned and the reference sound.

In the aforementioned exemplary embodiments, the indicator corresponding to the sound that is to be tuned emits red light while the indicator corresponding to the reference sound emits white light. In addition to the light colors, the lighting forms that distinguish the indicator corresponding to the sound that is to be tuned and the indicator corresponding to the reference sound may also include flash intervals of the LEDs, the lighting interval (the length of light-off time), etc. Moreover, the foini of decreasing or increasing of the luminance responsive to the pitch variation of the sound that is to be tuned is not necessarily a straight line as shown in the graph of FIG. 3 and may also be a curve.

According to the aforementioned exemplary embodiments, in the pitch display process of FIG. 6, if the difference Δ of the pitch of the sound that is to be tuned relative to the reference pitch is in the range of $-40$ cent$\leq\Delta\leq+40$ cent, the first indicator 21*a* and/or the second indicator 21*b* is lighted. However, a condition may be set to light the first indicator 21*a* and/or the second indicator 21*b* when the difference Δ remains in the range of $-40$ cent$\leq\Delta\leq+40$ cent over predetermined time (e.g. 500 ms or more). In such a case, the first indicator 21*a* or the second indicator 21*b* is not lighted instantly when the pitch of the sound that is to be tuned falls within this range (e.g. shorter than 10 ms), so as to prevent the auxiliary display 21 from flickering.

In the aforementioned exemplary embodiments, the brightness of the indicators 20*a*-20*l* of the pitch name display 20 is presented by the unit of "luminance." However, the brightness may also be presented by units, such as "illumination" or "luminosity," etc. Moreover, in the aforementioned exemplary embodiments, the luminance of 100% is exemplified as the maximum luminance; however, a luminance other than 100% may also be set as the relatively maximum luminance.

What is claimed is:

1. A tuning device, comprising:

an input means for inputting a sound;

a sound generation means generating a reference sound among a plurality of reference sounds according to a designated pitch;

an output means outputting the reference sound generated by the sound generation means;

a pitch detection means capable of detecting at least two pitches independently from a mixture of a sound that is to be tuned and the reference sound while the reference sound is outputted by the output means and the mixture of the sound to be tuned and the reference sound are inputted by the input means;

an acquiring means acquiring pitch information of the reference sound that is generated by the sound generation means;

a pitch extraction means extracting a pitch of the sound that is to be tuned from the at least two pitches detected by the pitch detection means, based on the pitch information acquired by the acquiring means;

a first display means capable of displaying information related to the pitch of the sound that is to be tuned;

a display control means displaying a first information related to the pitch of the sound that is to be tuned, which is extracted by the pitch extraction means, via the first display means;

a pitch name display means comprising a plurality of display positions that are arranged in a pitch order respectively corresponding to a plurality of pitch names that constitute an octave;

a pitch name determining means determining one of the plurality of pitch names that constitute the octave as a reference pitch name based on the pitch of the sound that is to be tuned, which is extracted by the pitch extraction means, wherein the reference pitch name has a pitch that is closest to the pitch of the sound that is to be tuned; and a first lighting control means lighting a reference display position, which is one of the display positions that corresponds to the reference pitch name, when a pitch difference between a reference pitch corresponding to the reference pitch name determined by the pitch name determining means and the pitch of the sound that is to be tuned is in a predetermined range, and lighting both the reference display position and an adjacent display position, which is the display position adjacent to the reference display position and corresponds to the pitch name that is close to the pitch of the sound that is to be tuned, in a way that a luminance of the reference display position gradually decreases and a luminance of the adjacent display position gradually increases as an absolute value of the pitch difference increases when the pitch difference is outside the predetermined range.

2. The tuning device according to claim 1, wherein the display control means controls the first display means to display information corresponding to a pitch difference between the pitch of the sound that is to be tuned, which is extracted by the pitch extraction means, and the pitch of the reference sound, which is shown by the pitch information acquired by the acquiring means, as the first information related to the pitch of the sound that is to be tuned.

3. The tuning device according to claim 1, further comprising a memory means that stores musical data, wherein the sound generation means generates the musical data stored by the memory means as the reference sound.

4. The tuning device according to claim 1, wherein the display control means controls the first display means to display a second information related to the pitch of the reference sound in a form different from that of the first information related to the pitch of the sound that is to be tuned.

5. The tuning device according to claim 1, further comprising a second display means that is capable of displaying a second information related to the pitch of the reference sound, wherein the display control means controls the second display means to display the second information related to the pitch of the reference sound.

6. The tuning device according to claim 1, wherein the display positions are circularly arranged in the pitch order in a way that the pitch name at one end and the pitch name at the other end of the octave adjoin each other.

7. The tuning device according to claim 6, further comprising:

an auxiliary display means comprising a first display position indicating that the pitch of the sound that is to be tuned deviates to a high pitch side relative to the reference pitch name, and a second display position indicating that the pitch of the sound that is to be tuned deviates to a low pitch side relative to the reference pitch name; and a second lighting control means controlling lighting of the first display position and the second display position responsive to the pitch difference.

8. The tuning device according to claim 3, wherein the display control means controls the first display means to display information corresponding to a pitch difference between the pitch of the sound that is to be tuned, which is extracted by the pitch extraction means, and the pitch of the reference sound, which is shown by the pitch information acquired by the acquiring means, as the first information related to the pitch of the sound that is to be tuned.

9. The tuning device according to claim 3, wherein the display control means controls the first display means to display a second information related to the pitch of the reference sound in a form different from that of the first information related to the pitch of the sound that is to be tuned.

10. The tuning device according to claim 3, further comprising a second display means that is capable of displaying a second information related to the pitch of the reference sound, wherein the display control means controls the second display means to display the second information related to the pitch of the reference sound.

11. The tuning device according to claim 3, wherein the display positions are circularly arranged in the pitch order in a way that the pitch name at one end and the pitch name at the other end of the octave adjoin each other.

12. The tuning device according to claim 11, further comprising:

an auxiliary display means comprising a first display position indicating that the pitch of the sound that is to be tuned deviates to a high pitch side relative to the reference pitch name, and a second display position indicating that the pitch of the sound that is to be tuned deviates to a low pitch side relative to the reference pitch name; and a second lighting control means controlling lighting of the first display position and the second display position responsive to the pitch difference.

* * * * *